United States Patent [19]

Hwang

[11] Patent Number: 4,986,678

[45] Date of Patent: Jan. 22, 1991

[54] REFILLABLE INK RIBBON CARTRIDGE FOR USE IN AN ELECTRONIC TYPEWRITER

[76] Inventor: Chiman Hwang, 28606 Pacific Hwy So. 65, Federal Way, Wash. 98003

[21] Appl. No.: 446,418

[22] Filed: Dec. 5, 1989

[51] Int. Cl.[5] ..... B41J 35/28

[52] U.S. Cl. ..... 400/208; 400/693.1

[58] Field of Search ..... 400/194, 195, 196, 196.1, 400/197, 198, 199, 200–202.4, 207, 208, 208.1, 248, 248.1, 693.1; 242/197, 199

[56] References Cited

U.S. PATENT DOCUMENTS

| | | | |
|---|---|---|---|
| 3,951,253 | 4/1976 | Tibay et al. | 400/202.1 |
| 4,289,413 | 9/1981 | Seplin | 400/196 |
| 4,359,288 | 11/1982 | Bulloch et al. | 400/208 |
| 4,406,553 | 9/1983 | Nally et al. | 400/208 |
| 4,655,623 | 4/1987 | Gasser | 400/208 |
| 4,720,202 | 1/1988 | Kawakami | 400/208 |
| 4,806,033 | 2/1989 | Ukmar et al. | 400/208 |
| 4,854,755 | 8/1989 | Lange et al. | 400/208 |

FOREIGN PATENT DOCUMENTS

| | | | |
|---|---|---|---|
| 99442 | 4/1984 | European Pat. Off. | 400/208 |
| 2504858 | 11/1982 | France | 400/208 |
| 230484 | 4/1985 | German Democratic Rep. | 400/208 |
| 154876 | 7/1986 | Japan | 400/208 |
| 227082 | 9/1986 | Japan | 400/208 |

OTHER PUBLICATIONS

Xerox Technical Disclosure Bulletin, "Ribbon Advance Mechanism" P. Mikes, vol. 2, No. 4, Jul./Aug. 1977; p. 77.

*Primary Examiner*—David A. Wiecking
*Assistant Examiner*—Joseph R. Keating
*Attorney, Agent, or Firm*—Birch, Stewart, Kolasch & Birch

[57] ABSTRACT

A refillable ink ribbon cartridge for use in an electronic typewriter which includes a housing, a feed spool having a semi-globe member for slidably mounted to and removed from a movable diamond-shaped plate, a winding spool for slidably inserting into and removed from the diamond-shaped plate, and a jagged wheel, whereby the used ink ribbon cartridge can be reused and maintains a constant tension on an ink ribbon between the feed and winding spool.

19 Claims, 7 Drawing Sheets

REFILLABLE INK RIBBON CARTRIDGE FOR USE IN AN ELECTRONIC TYPEWRITER

BACKGROUND OF THE INVENTION

1. Field of the Invention

The present invention relates to a refillable ink ribbon cartridge for use in an electronic typewriter or a printer and more particularly, to an ink ribbon cartridge for use in an electronic typewriter which includes a changeable feed spool easily replaced through and a winding spool about which is wound a used ribbon which is easily taken out of the cartridge through a casing cover opening on a casing cover of the cartridge, whereby the used cartridge can be reused without creating waste materials.

2. Description of the Prior Art

Various types of disposal ink ribbon cartridges are well known in the art. For example, in such disposal ink ribbon cartridges, the feed spool and the winding spool are operatively maintained the resilience of an ink ribbon by a feed spool spring as described in U.S. Pat. No. 4,406,554 to Nally et al and U.S. Pat. No. 4,655,623 to Gasser. However, such ink ribbon cartridges are incapable of allowing replacement of the feed spool and must be thrown away with the used ribbon after one use so as to create large amounts of waste materials.

In order to avoid such problems, the present inventor is prosecuting U.S. patent application Ser. No. 07/426,670, filed Oct. 26, 1989, which disclosed a refillable ink ribbon cartridge for use in an electronic typewriter which includes a housing, a feed spool member having symmetric C-shaped springs for slidably receiving and removing a changeable feed spool, a winding spool member having a lever and a lever opener for slidably inserting and removing a winding spool, and a jagged wheel whereby the used ink ribbon cartridge can be reused and maintains a constant tension on the ink ribbon between the feed and winding spools.

SUMMARY OF THE INVENTION

Accordingly, it is an object of the present invention to provide a refillable ink ribbon cartridge for use in an electronic typewriter.

Another object of the present invention is to provide an ink ribbon cartridge which includes a changeable feed spool replaced through and a winding spool about which is wound a used ribbon which may is removed therefrom through only a casing cover opening on a casing cover of the cartridge.

A further object of the present invention is to provide a refillable ribbon cartridge which includes a feed spool slidably mounted to and removed from a movable diamond-shaped plate by a semi-globe member engaged with the feed spool, and a winding spool slidably inserting into and removed from the movable diamond-shaped plate by a spring arm extended from a pivotal connecting spring for the diamond-shaped plate whereby the ribbon cartridge can be reused.

Still another object of the present invention is to provide a refillable ribbon cartridge which includes a semi-globe member which can be inserted into a winding spool so as to convert to a feed spool.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a refillable ink ribbon cartridge for use in an electronic typewriter which includes a housing, a feed spool having a semi-globe member for slidably mounted to and removed from a movable diamond-shaped plate, a winding spool for slidably inserting into and removing from the diamond-shaped plate, and a jagged wheel, whereby the used ink ribbon cartridge can be reused and maintains a constant tension on an ink ribbon between the feed and winding spool.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 10:
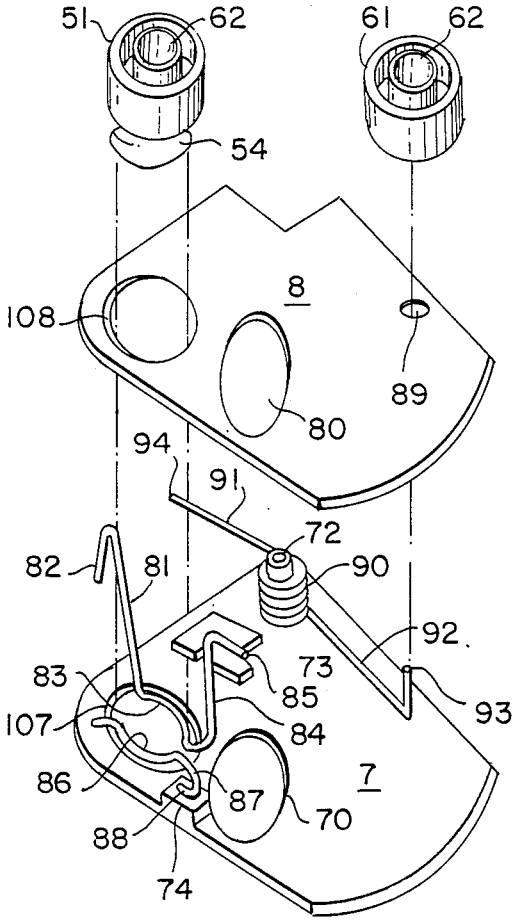
FIG. 10 is an exploded view of the diamond-shaped plate and basic components of the refillable ink ribbon cartridge according to the present invention showing a semi-globe member which can be inserted into a winding spool for converting the winding spool to a feed spool.

Referring now in detail to the drawings for the purpose of illustrating preferred embodiments of the present invention, the refillable ink ribbon cartridge 1 as shown in FIGS. 1–6 comprises a housing including a casing base 2, a front casing cover 3, a C-shaped top cover 15, a winding spool side wall 12, a bottom plate 13, a feed spool member including a feed spool 51 with a semi-globe member 54, a winding spool member including a winding spool 61 disposed within the housing, and a drive roller 4 in the vicinity of the winding spool 61. The front casing cover 3 includes a casing cover opening 30 having a pair of extended semi-circular finger holes 31 and 32 for inserting the feed spool 51 having a brand new ribbon 5 and removing the winding spool 61 having an used ribbon 6 into and from the ribbon cartridge 1. Also, a guide pin 36 supported on the casing base 2 and a first spring arm 82 of a first feed spool spring 81 for passing an ink ribbon 9 therethrough from the feed spool 51 to the winding spool 61 (FIG. 10). The winding spool side wall 12 is provided with a gulf 17 in the vicinity of the winding spool 61 for easily connecting the ink ribbon 9 to the winding spool 61 by the use of a finger.

A feed spool side opening 34 is disposed on a feed spool side 14 of the ribbon cartridge 1 for easily engaging the new ribbon 5, with the first spring arm 82 in the ribbon cartridge 1. The front casing cover 3 has a ribbon channel 33 for easily transporting the new ribbon 5 into the winding spool 61. A winding spool side opening 35 is disposed on a winding spool side of the ribbon cartridge 1 for easily engaging the used ribbon 6 with the guide pin 36 in the ribbon cartridge 1. The front casing cover 3 has a gulf 17 for easily handling the used ribbon 6.

Figure 5:
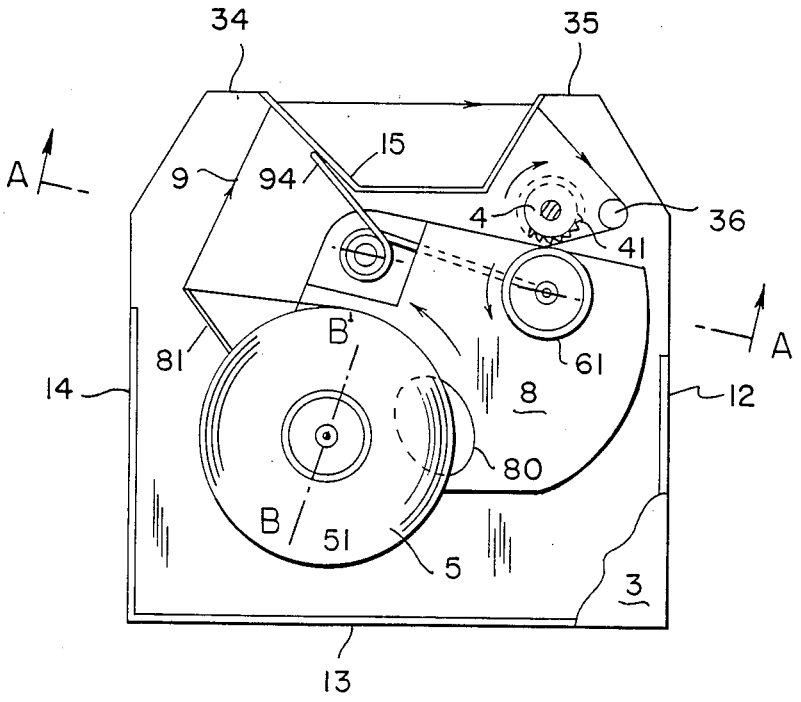
FIG. 5 is a front elevational view of FIG. 1 showing cut away portions thereof a diamond-shaped plate provided with a feed spool and a winding spool.
Figure 6:
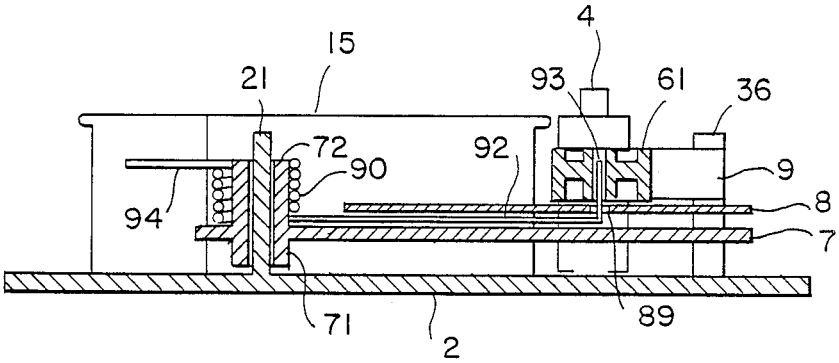
FIG. 6 is a cross-sectional view of FIG. 5, taken along line A—A.
Figure 7:
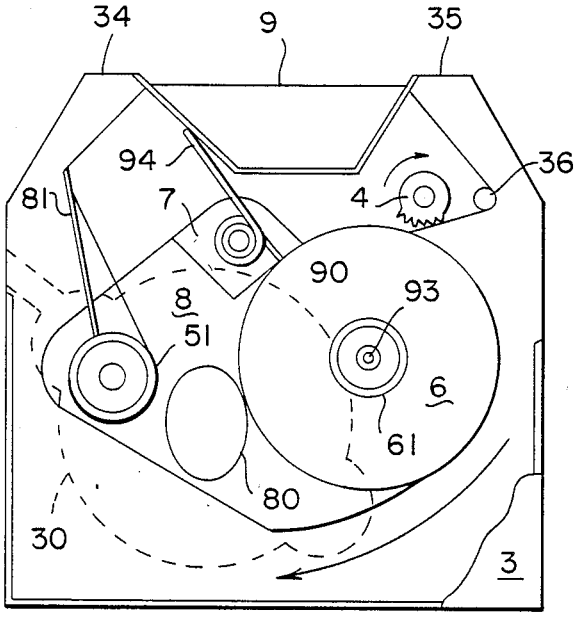
FIG. 7 is a front elevational view of FIG. 5 showing in cut away portions thereof an old ribbon wound around the winding spool according to the present invention.

As shown in FIGS. 5, 7, and 10, a diamond-shaped plate defines an upper plate 8 and a lower plate 7. The lower plate 7 is provided with a fixed pin having a lower end 71, 72 including a support pin 21 supported on the casing base 2 and casing cover 3 for pivotably receiving a pivotal spring ring 90, a circular hole 107, and an elliptic hole 70 disposed thereon. The upper plate 8 has a circular hole 108 and an elliptic hole 80 for mating with the circular hole 107 and elliptic hole 70 of the lower plate 7. The lower and upper plates 7 and 8 are adhered together and the first feed spool spring 81 and a second feed spool spring 87 are located on the circular holes 107 and 108 and between the lower and upper plates 7 and 8. The first feed spool spring 81 intends an extension arm 84 and its end 73 fixed in a stopper 85 and the second feed spool spring 86 extends its end 87 fixed in an end engagement 88. The pivotal spring ring 90 extends a pair of extension arms 91 and 92 and the extension arm 92 has a spring arm 93 disposed at end thereof for slidably receiving the winding spool 61. The first feed spool spring 81 and second feed spring 87 have a C-shaped configuration with semi-circles 83 and 86, respectively, for slidably receiving the semi-globe member 54. The semi-globe member can be inserted into the winding spool 61 so as to convert the winding spool 61 to the feed spool 51. Thus the first feed spool spring 81 has the semi-circle 83 disposed around the center thereof and extends the spring arm as a hook 82 at one end thereof for passing the ink ribbon 9 therethrough.

Figure 8:
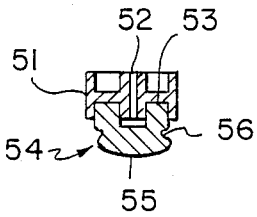
FIG. 8 is a sectional view of a semi-globe member engaged with the feed spool according to the present invention.

The C-shaped second feed spool spring 87 is symmetrically disposed at the C-shaped first feed spool spring 81 for slidably receiving the semi-globe member 54 therethrough. Also the second feed spool spring 87 is provided with an end engagement 88 at one end thereof for readily engaging with a stopper 74 disposed on the inside surface of the lower plate 7 of the diamond-shaped plate so as to give a constant biasing force to the semi-circle 86 for tight positioning against a groove 56 of the semi-globe 54 member (FIG. 8). Thus the feed spool 51 can be easily engaged between both semi-circles 83 and 86 of the first and second feed spool springs 81 and 87 through the groove 56 of the semi-globe member 54.

Also, the semi-globe member 54 can be inserted into the winding spool 61. Therefore, the winding spool 61 assembled with the semi-globe member 54 can convert the winding spool 61 to the feed spool 51 (FIG. 10).

Figure 9:
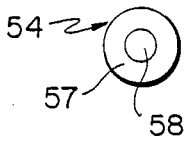
FIG. 9 is a top plan view of the semi-globe member.
Figure 13:
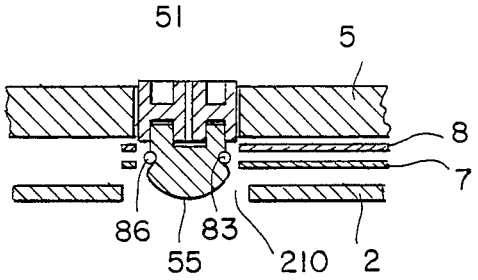
FIG. 13 is a cross-sectional view of FIG. 5, taken along line B—B.

As shown in FIGS. 8, 9, 13, the semi-globe member 54 mounted to a hub having a hole 52 of the feed spool 51 through a circular slot 53 disposed in the bottom thereof has the circular groove 56 and a head 55 for touching to the casing base 2 when the feed spool 51 is inserted into the both semi-circles 83 and 86 of the first and second feed spool springs 81 and 87. The first feed spring 81 has an end 85 fixed to a support plate 73 supported on the lower plate 7. Also, the reference numerals 57 and 58 are a circumferential raised portion and a groove, respectively (FIG. 9).

As shown in FIGS. 5, 7, and 10, a fixed pin 72 supported on the casing base 2 receives a pivotal spring ring 90 of an L-shaped spring 92 for engaging with an aperture 89 of the upper plate 8. The spring arm 93 of the spring 92 is engaged in an aperture 62 of a hub of the winding spool 61 and biased against the end 94 of the extension spring 91.

Figure 11:
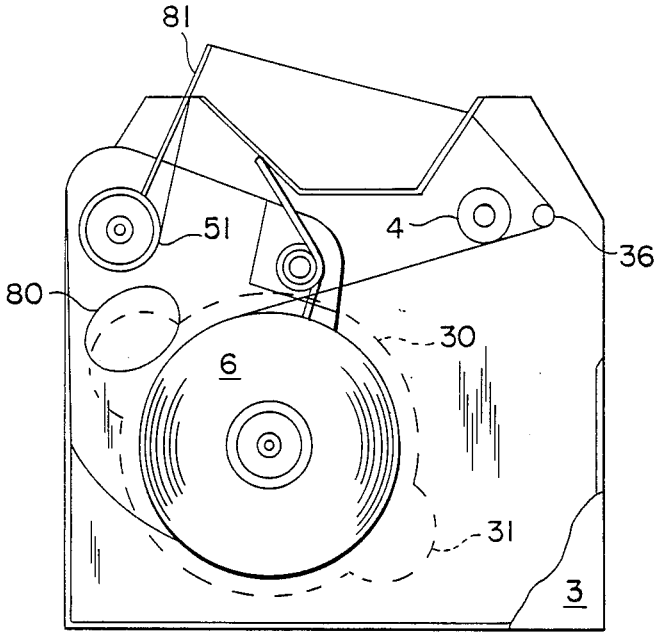
FIG. 11 is a front elevational view showing the movement of the diamond-shaped plate to be taken out the winding spool with an old ribbon.
Figure 12:
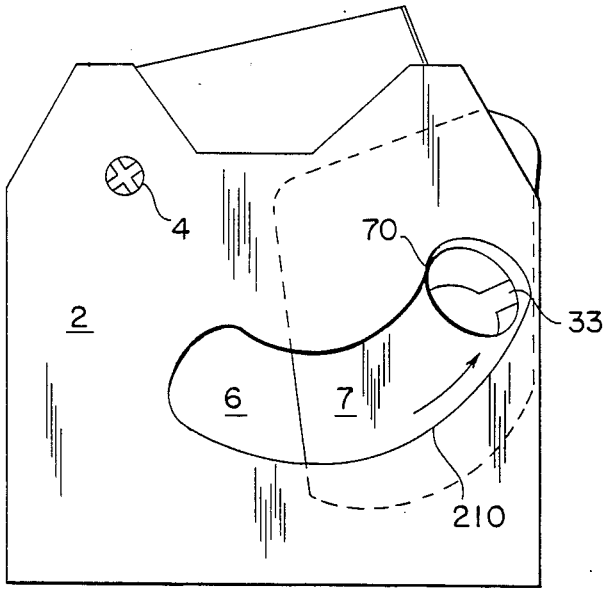
FIG. 12 is a rear elevational view of FIG. 11.
Figure 18:
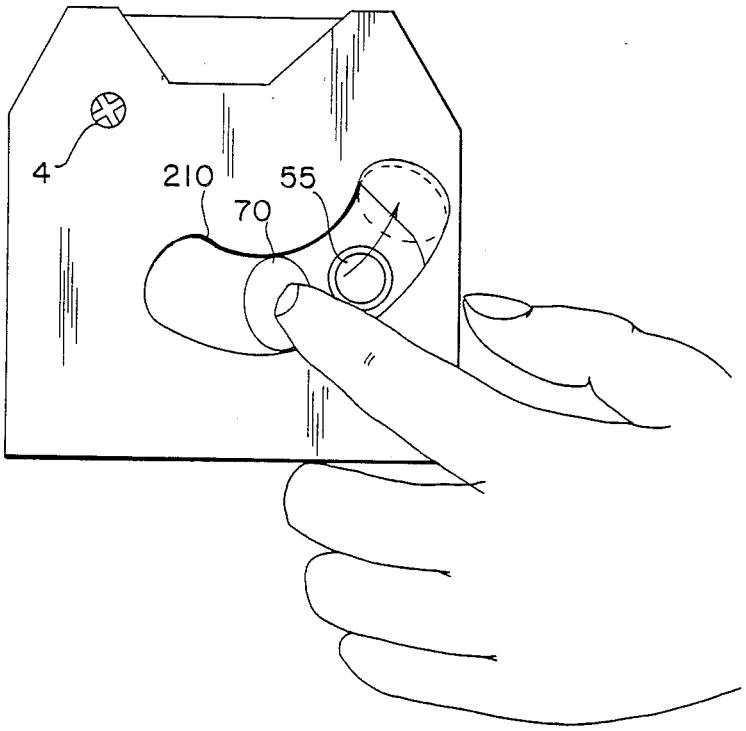
FIG. 18 is a rear elevational view of FIG. 7 showing the diamond-shaped plate operated by the finger.

As shown in FIGS. 11, 12, and 18, a banana-shaped opening 210 having a lower end 211 and an upper end 212 and disposed on the casing base 2 is slidably placed on the elliptic finger hole 70 so that the diamond-shaped plate is moved in the direction as indicated by arrow as shown in FIG. 12. Thereafter, when the winding spool 61 having the used ribbon 6 is moved in the casing cover opening 30, the winding spool 61 is taken out of the ribbon cartridge 1 (FIG. 11).

As shown in FIGS. 5 and 7, the driver roller 4 has a jagged wheel 41 for resisting the used ribbon 9 of the winding spool 61 and maintaining a constant tension on the ink ribbon 9 between the feed spool 51 and the winding spool 61 so that the ribbon 9 from the feed spool 51 has a substantially constant resilient force.

Figure 14:
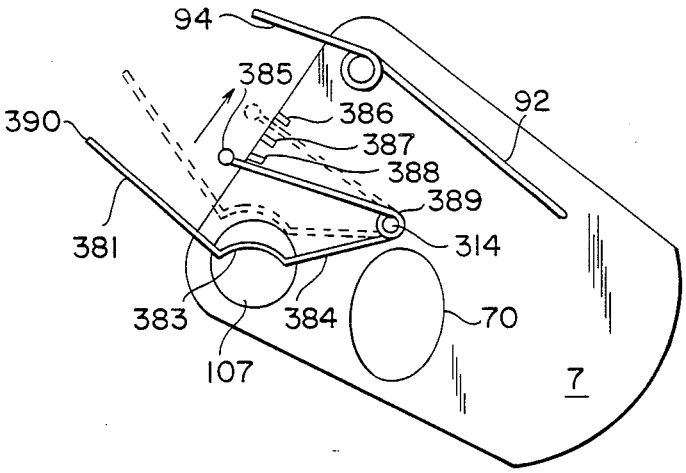
FIG. 14 is a front elevational view illustrating another embodiment of the feed spool member of the refillable ink ribbon cartridge according to the present invention.
Figure 15:
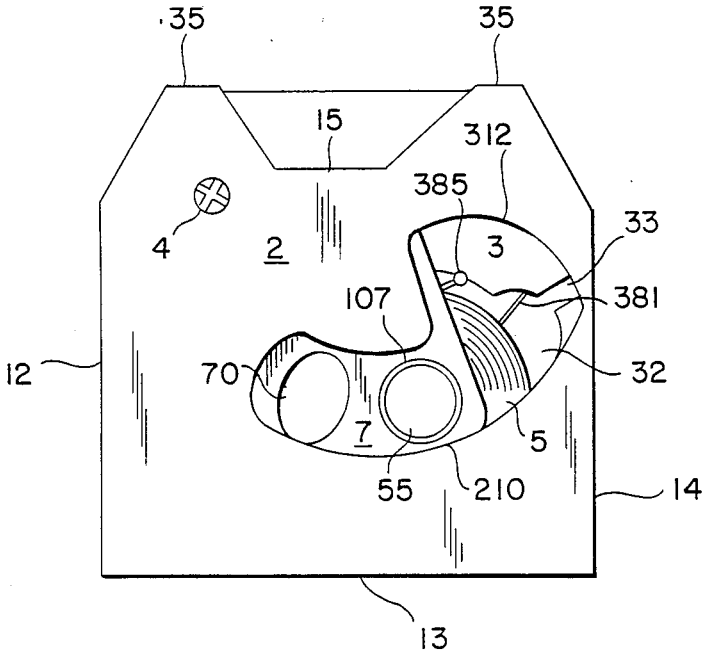
FIG. 15 is a rear elevational view of FIG. 14.

Referring in detail to FIGS. 14 and 15, there is illustrated an another embodiment of an ink ribbon cartridge 1 according to the present invention. The second feed spool spring 87 is removed from the ink ribbon cartridge, and instead of the first feed spool spring 81 of FIG. 10, a feed spool spring 384 maintains the position of the feed spool 51 for slidably inserting the feed spool 51 into the ribbon cartridge 1 through the circular hole 107 disposed on the diamond-shaped plate. The feed spool spring 384 is pivotably connected about a fixed pin 314 supported on the diamond-shaped plate through a spring ring 389. Also, a plurality of stoppers 386, 387, and 388 are disposed on the inside surface of the lower plate 7 for stopping a spring arm 385 between the stoppers 386 and 387, 387 and 388, or 388 and spring ring 389 so as to give a constant biasing force to a semi-circle 383 of the first feed spool spring 384 for tight positioning against the circular groove 56 of the semi-globe 54 mounted to the feed spool 51. The banana-shaped opening 210 has a large upper end 312 and the reference numeral 381 is the feed spool spring.

Figure 16:
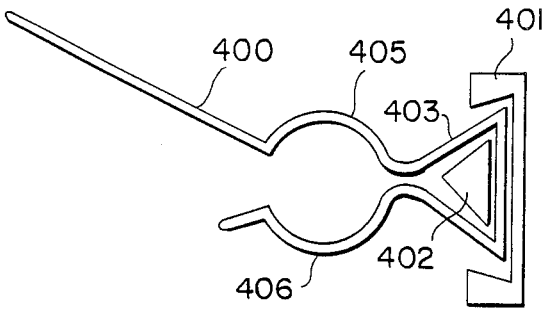
FIG. 16 is a front elevational view illustrating still another embodiment of the feed spool spring member of a refillable ink ribbon cartridge according to the present invention.

Referring in detail to FIG. 16, there is illustrated still another embodiment of an ink ribbon cartridge 1 according to the present invention. Instead of the first and second feed spool springs 81 and 87 as shown in FIG. 10, a single feed spool spring 400 maintains the position of the feed spool 51 for slidably inserting the feed spool 51 into the ribbon cartridge 1. The single feed spool spring 400 is provided symmetric semi-circles 405 and 406, and a triangular tail 403 which is fixed with a triangle pin 402 and a C-shaped support 401 supported on the low plate 7.

Figure 17:
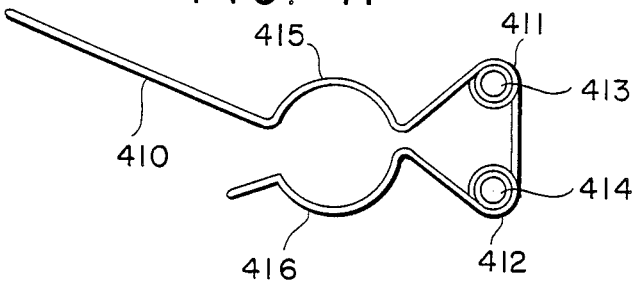
FIG. 17 is a front elevational view illustrating a further embodiment of the feed spool spring member of a refillable ink ribbon cartridge according to the present invention.

Referring in detail to FIG. 17, there is illustrated a further embodiment of an ink ribbon cartridge 1 according to the present invention. In the ink ribbon cartridge of FIG. 16, a single feed spool spring 410 having symmetric semi-circles 415 and 416 on the inside surface of the low plate 7. Also, fixing pins 413 and 414 are supported on the inside surface of low plate 7 for pivotably engaging in spring rings 411 and 412 of the feed spool spring 410.

According to the present invention, the ink ribbon cartridge operates as follows:

As shown in FIGS. 1, 10, 12, and 18, the feed spool 51 is inserted into the space between the first feed spool spring 81 and the second feed spool spring 87 for tightly mating circular groove 56 of the semi-globe 5 mounted to the feed spool 51 with both semi-circles 83 and 86 of the spool springs 81 and 87. At this time, the spring arm 93 of the L-shaped spring 92 engages in the aperture 62 of the winding spool 61. In addition, the jagged wheel 41 controls the speed of rotation of the winding spool 61. Thus, by both of the above-mentioned factors, the ink ribbon 9 to be used for typing is maintained at a constant tension.

Figure 1:
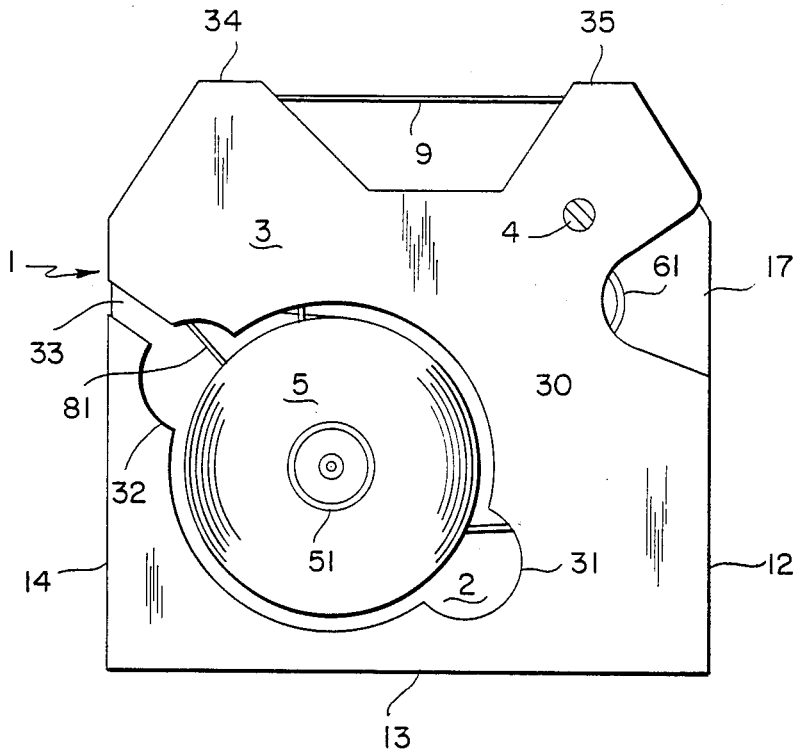
FIG. 1 is a front elevational view of a refillable ink ribbon cartridge according to the present invention showing a feed spool disposed in a casing cover opening having a pair of semi-circular finger holes.
Figure 2:
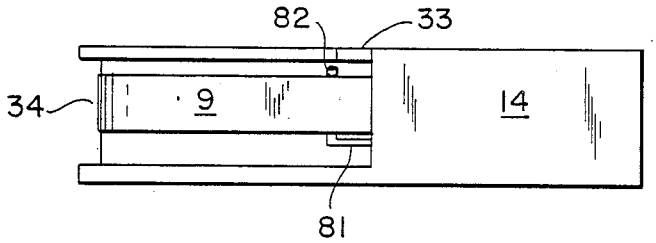
FIG. 2 is a left side elevational view of FIG. 1 showing a left side opening.
Figure 3:
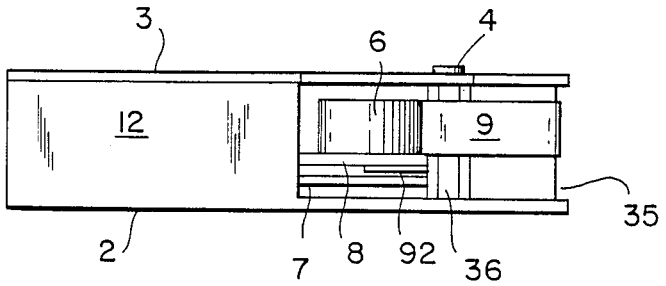
FIG. 3 is a right side elevational view of FIG. 1 showing a right side opening.
Figure 4:
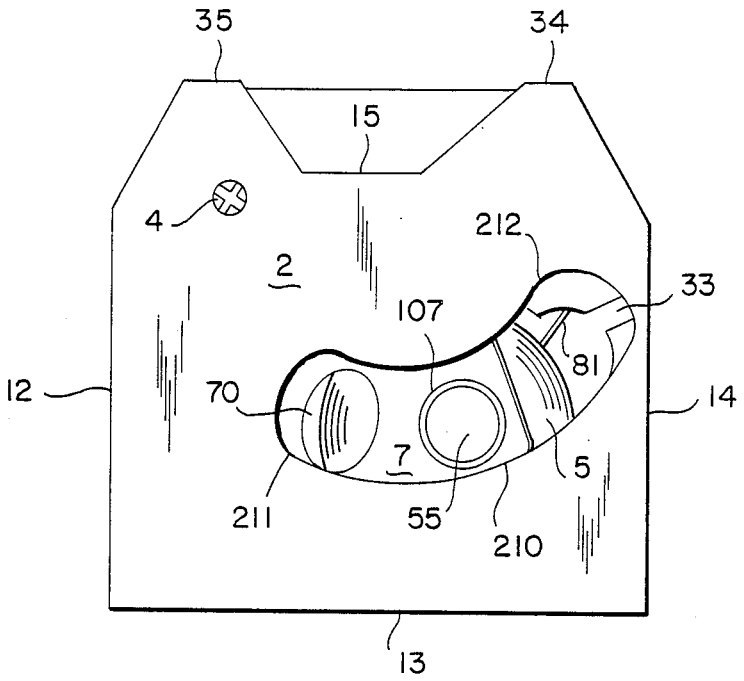
FIG. 4 is a rear elevational view of FIG. 1 showing a banana-shaped finger hole.

The ink ribbon 9 from the feed spool 51 is connected to the winding spool 61 through the hook 82 of the first feed spool spring 81 and guide pin 36. At this time, it is easy for the finger to attach the end of ink ribbon 9 to the hub of the winding spool 61 through the gulf 17 (FIG. 1).

When the ink ribbon 9 of the feed spool 51 is finally moved to the winding spool 61, after the winding spool 61 wound by the used ribbon 6 is removed from the cartridge by moving the diamond-shaped plate in the direction as indicated by the arrow shown in FIG. 7, the exhausted feed spool 51 can be easily exchanged for a new one. Thereafter, the frame of the winding spool 61 can be reused by inserting it into the ribbon cartridge 1 by returning the diamond-shaped plate to the origin position thereof. Accordingly, the used ribbon cartridge 1 can be easily reused.

As shown in FIG. 14, another embodiment of the ribbon cartridge 1 according to the present invention operates as follows:

After the feed spool spring 384 is moved up in the direction indicated by an arrow from the original position to the position (dotted lines) as shown in FIG. 14, the feed spool 51 is inserted into the ribbon cartridge 1 through the casing cover spring 30. At this time, the feed spool spring 384 is returned to the original position and the extension arm spring 385 is engaged within the space between the stopper 388. Also, in order to give a tension to the ink ribbon 9, the ink ribbon 9 has to pass the spring end 390 thereof.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A refillable ink ribbon cartridge for use in an electronic typewriter and a printer which comprises:

a case housing including a casing base having a banana-shaped opening, a front casing cover, a casing cover opening, a top cover, a feed spool side wall, a winding spool side wall, and a bottom plate, said front casing cover having casing cover opening disposed in the vicinity of said feed spool side wall, a plurality of spring fixing members disposed in said case housing, a changeable feed spool engaged within said case housing, said changeable feed spool having a hub and provided with a C-shaped first feed spool spring and a C-shaped second feed spool spring pivotably disposed in said case housing about said spring fixing members, respectively, for being symmetrically located adjacent to each other and for holding the hub of the feed spool in the space between said first and second feed spool springs, an ink ribbon, a replaceable winding spool engaged within said case housing in the vicinity of said changeable feed spool for winding said ink ribbon received from said feed spool, said replaceable winding spool provided with a spring arm of a pivotal connecting spring for connecting to a hub of the winding spool, a fixed pin supported on said casing base, a movable plate having an elliptic opening and a circular hole disposed thereon, said movable plate pivotably moving about said fixed pin and front casing cover through the pivotal connecting spring engaged with said fixed pin by a pivotal spring ring for taking out the winding spool of the casing housing when the movable plate moves from the origin position, means for transferring the ink ribbon from said feed spool to said winding spool, and a drive roller having a jagged wheel disposed within said housing means and in the vicinity of said winding spool for maintaining tension on the ink ribbon on the winding spool, whereby the feed spool can be inserted into and removed from the ribbon cartridge through the casing cover opening and the winding spool can be replaced after removal of the used ink ribbon wound about the winding spool by moving the movable plate from the origin position so that the used cartridge can be reused and maintains a certain tension on the ink ribbon between the feed spool and winding spool.

2. The refillable ink ribbon cartridge of claim 1, wherein the top cover has a C-shaped configuration.

3. The refillable ink ribbon cartridge of claim 1, wherein the C-shaped first feed spool spring has a semicircle disposed in the center thereof for tightly contacting with the hub of the feed spool.

4. The refillable ink ribbon cartridge of claim 3, wherein a semi-globe member is engaged in the circular hole and also mounted to the hub of the feed spool, said semi-globe member including a circular groove for slidably and tightly engaging with the semi-circles of first and second feed spool springs.

5. The refillable ink ribbon cartridge of claim 4, wherein the semi-globe member is inserted into the winding spool so as to convert the winding spool to the feed spool.

6. The refillable ink ribbon cartridge of claim 3, wherein the elliptic opening is slidably placed on the banana-shaped opening for easily moving the elliptic opening disposed on the movable plate within the banana-shaped opening.

7. The refillable ink ribbon cartridge of claim 1, wherein the C-shaped second feed spool spring has a semi-circle disposed in the center thereof for tightly contacting with the hub of the feed spool.

8. The refillable ink ribbon cartridge of claim 1, wherein a plurality of gulfs are disposed on said housing and in vicinity of said winding spool for easily handling the winding spool.

9. The refillable ink ribbon cartridge of claim 1, wherein the spring fixing members are supported on said movable plate.

10. The refillable ink ribbon cartridge of claim 1, wherein the transferring means comprises a hook formed at one end of said C-shaped first feed spool spring, and a plurality of pins supported on said casing base for tightly moving from the feed spool to the winding spool.

11. A refillable ink ribbon cartridge for use in an electronic typewriter and a printer which comprises:

a case housing including a casing base having a banana-shaped opening, a front casing cover, a casing cover opening, a top cover, a feed spool side wall, a winding spool side wall, and a bottom plate, and said front casing cover having casing cover opening disposed in the vicinity of said feed spool side wall, a pin disposed in said case housing, a changeable feed spool engaged within said case housing, said changeable feed spool having a hub and provided with a C-shaped first feed spool spring pivotably disposed in said movable plate about said pin for holding a circular groove of a semi-globe mounted to a hub of the feed spool, an ink ribbon, a replaceable winding spool engaged within said case housing and in the vicinity of said changeable feed spool for winding said ink ribbon received from said feed spool, said replaceable winding spool provided with a spring arm of a pivotal connecting spring for connecting to a hub of the winding spool, a fixed pin supported on said casing base, a movable plate having an elliptic opening and a circular hole disposed thereon, said movable plate pivotably moving about said fixed pin and front casing cover through the pivotal connecting spring engaged with said fixed pin by a pivotal spring ring for taking out the winding spool of the casing housing when the movable plate moves from the origin position, means for transferring the ink ribbon from said feed spool to said winding spool, and a drive roller having a jagged wheel disposed within said housing means and in the vicinity of said winding spool for maintaining tension on the ink ribbon on the winding spool, whereby the feed spool can be inserted into and removed from the ribbon cartridge through the casing cover opening and the winding spool can be replaced after removal of the used ink ribbon wound about the winding spool by moving the movable plate from the origin position so that the used cartridge can be reused and maintains a certain tension on the ink ribbon between the feed spool and winding spool.

12. The refillable ink ribbon cartridge of claim 11, wherein the C-shaped first feed spool spring has a semi-circle disposed in the center thereof for tightly contacting with the hub of the feed spool and is provided with a plurality of stoppers supported on the inside surface of the front casing cover for receiving a spring arm extended therefrom for tightly holding the feed spool so as to control the tension thereof.

13. The refillable ink ribbon cartridge of claim 11, wherein a plurality of gulfs are disposed on said housing and in vicinity of said winding spool for easily handling the winding spool.

14. The refillable ink ribbon cartridge of claim 11, wherein the transferring means defines a hook formed at one end of said pivotal spring and a plurality of pins supported on said casing base for tightly moving from the feed spool to the winding spool.

15. The refillable ink ribbon cartridge of claim 11, wherein the top cover has a C-shaped configuration.

16. A refillable ink ribbon cartridge for use in an electronic typewriter and a printer which comprises:

a case housing including a casing base having a banana-shaped opening, a front casing cover, a casing cover opening, a top cover, a feed spool side wall, a winding spool side wall, and a bottom plate, and said front casing cover having casing cover opening disposed in the vicinity of said feed spool side wall, a changeable feed spool engaged within said case housing, said changeable feed spool having a hub and provided with a C-shaped first feed spool spring and a C-shaped feed spool spring disposed on said movable plate about a triangular pin for holding said hub of the feed spool in the space between both semi-circles thereof, an ink ribbon, a replaceable winding spool engaged within said case housing and in the vicinity of said changeable feed spool for winding said ink ribbon received from said feed spool, said replaceable winding spool provided with a spring arm of a pivotal connecting spring for connecting to a hub of the winding spool, a fixed pin supported on said casing base, a movable plate having an elliptic opening and a circular hole disposed thereon, said movable plate pivotably moving about said fixed pin and front casing cover through the pivotal connecting spring engaged with said fixed pin by a pivotal spring ring for taking out the winding spool of the casing housing when the movable plate moves from the origin position, means for transferring the ink ribbon from said feed spool to said winding spool, and a drive roller having a jagged wheel disposed within said housing means and in the vicinity of said winding spool for maintaining tension on the ink ribbon on the winding spool, whereby the feed spool can be inserted into and removed from the ribbon cartridge through the casing cover opening and the winding spool can be replaced after removal of the used ink ribbon wound about the winding spool by moving the movable plate from the origin position so that the used cartridge can be reused and maintains a certain tension on the ink ribbon between the feed spool and winding spool.

17. The refillable ink ribbon cartridge of claim 16, wherein the top cover has a C-shaped configuration.

18. The refillable ink ribbon cartridge of claim 16, wherein a plurality of gulfs are disposed on said housing and in vicinity of said winding spool for easily handling the winding spool.

19. The refillable ink ribbon cartridge of claim 16, wherein the C-shaped feed spool spring is disposed on said movable plate about a pair of pins for holding a hub of the feed spool in the space between both semi-circles thereof.

* * * * *